US007378009B2

(12) United States Patent
Svoevskiy et al.

(10) Patent No.: US 7,378,009 B2
(45) Date of Patent: May 27, 2008

(54) METHOD OF CONTROLLING AN ALUMINUM CELL WITH VARIABLE ALUMINA DISSOLUTION RATE

(75) Inventors: Alexey V. Svoevskiy, Krasnoyarsk (RU); Oleg O. Rodnov, Krasnoyarsk (RU); Alexander I. Berezin, Krasnoyarsk (RU); Victor Y. Buzunov, Krasnoyarsk (RU)

(73) Assignee: Russian Engineering Company, LLC (RU)

( * ) Notice: Subject to any disclaimer, the term of this patent is extended or adjusted under 35 U.S.C. 154(b) by 277 days.

(21) Appl. No.: 11/121,585

(22) Filed: May 4, 2005

(65) Prior Publication Data

US 2005/0247568 A1 Nov. 10, 2005

(30) Foreign Application Priority Data

May 5, 2004 (RU) ..... 2004113864

(51) Int. Cl.
*C25C 3/20* (2006.01)

(52) U.S. Cl. ..... 205/392; 205/389; 205/335; 205/336; 205/337; 205/375; 205/372

(58) Field of Classification Search ..... 205/392, 205/389, 335, 336, 337, 375, 372; 204/247.1, 204/247.5

See application file for complete search history.

(56) References Cited

U.S. PATENT DOCUMENTS 4,431,491 A 2/1984 Bonny et al.
4,668,350 A 5/1987 Desclaux et al.
5,089,093 A * 2/1992 Blatch et al. ..... 205/336

FOREIGN PATENT DOCUMENTS

RU 2113552 6/1998
RU 2189403 9/2002

OTHER PUBLICATIONS (1) Robilliard and Rolofs, A Demand Feed Strategy For Aluminum Electrolysis Cells, Granges Aluminum Metall AB, Sundsvall, Sweden, published in Light Metals 1989, The Minerals, Metals, & Materials Society, p. 269-273.

* cited by examiner

*Primary Examiner*—Bruce F. Bell
(74) *Attorney, Agent, or Firm*—Lawrence G. Fridman

(57) ABSTRACT

A method of controlling an aluminum reduction cell including the following steps:

maintaining alumina concentration within preset limits by alternating base, underfeed and overfeed modes; measuring cell voltage and potline amperage; calculating current normalized voltage value and a rate of changing thereof in time; comparing the calculated values of the normalized voltage with preset values thereof and correcting anode-cathode distance when passing from the base mode to the overfeed or underfeed modes; and measuring a number of alumina feed doses in the underfeed mode and overfeed mode over a time period sufficient for the alumina to dissolve.

20 Claims, 6 Drawing Sheets

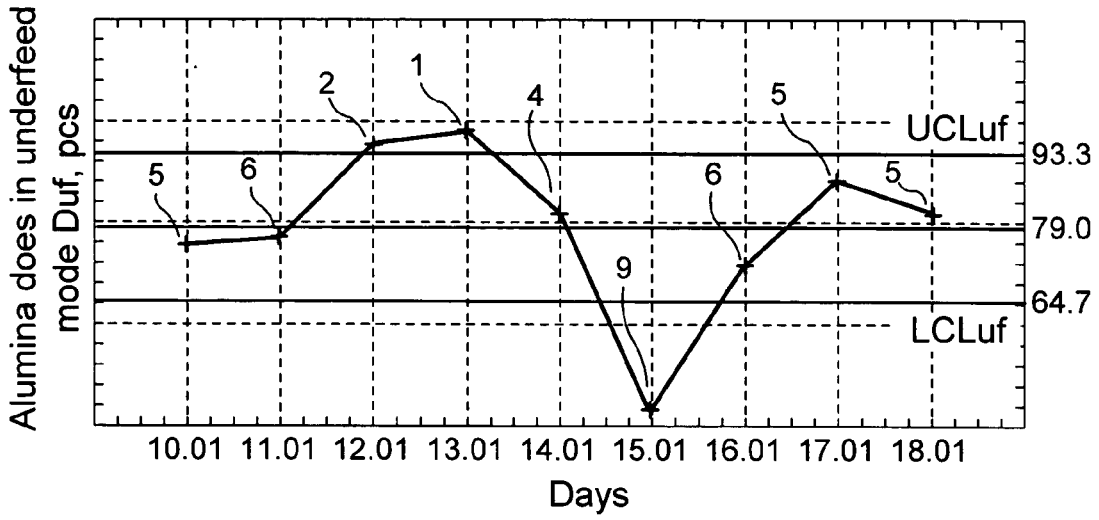
F I G. 1A. Shewhart control chart -- individual values (I-MR) of alumina doses in underfeed mode $D_{UF}$ (sigma =14.3)
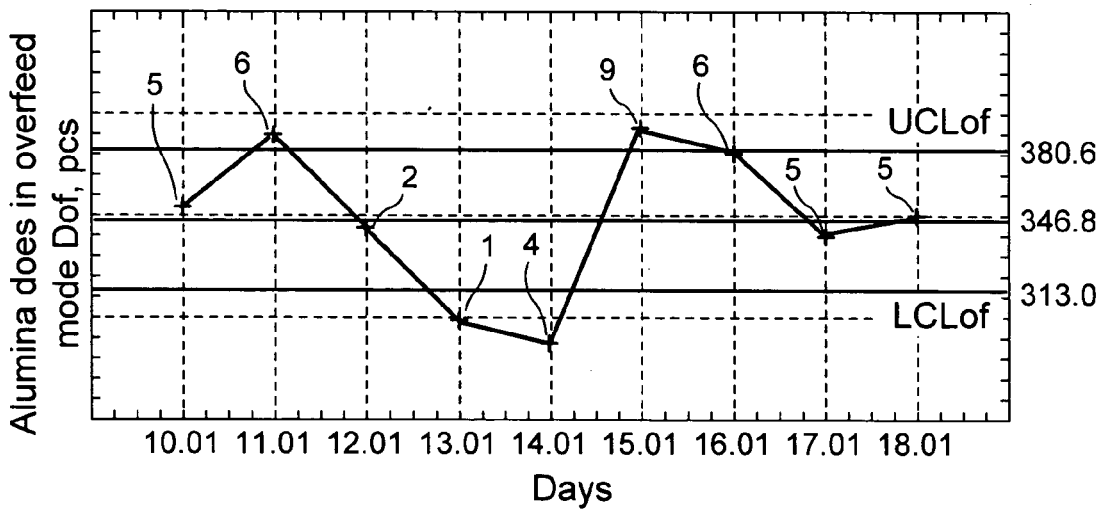
F I G. 1B. Shewhart control chart -- individual values (I-MR) of alumina doses in overfeed mode $D_{OF}$ (sigma = 33.3)

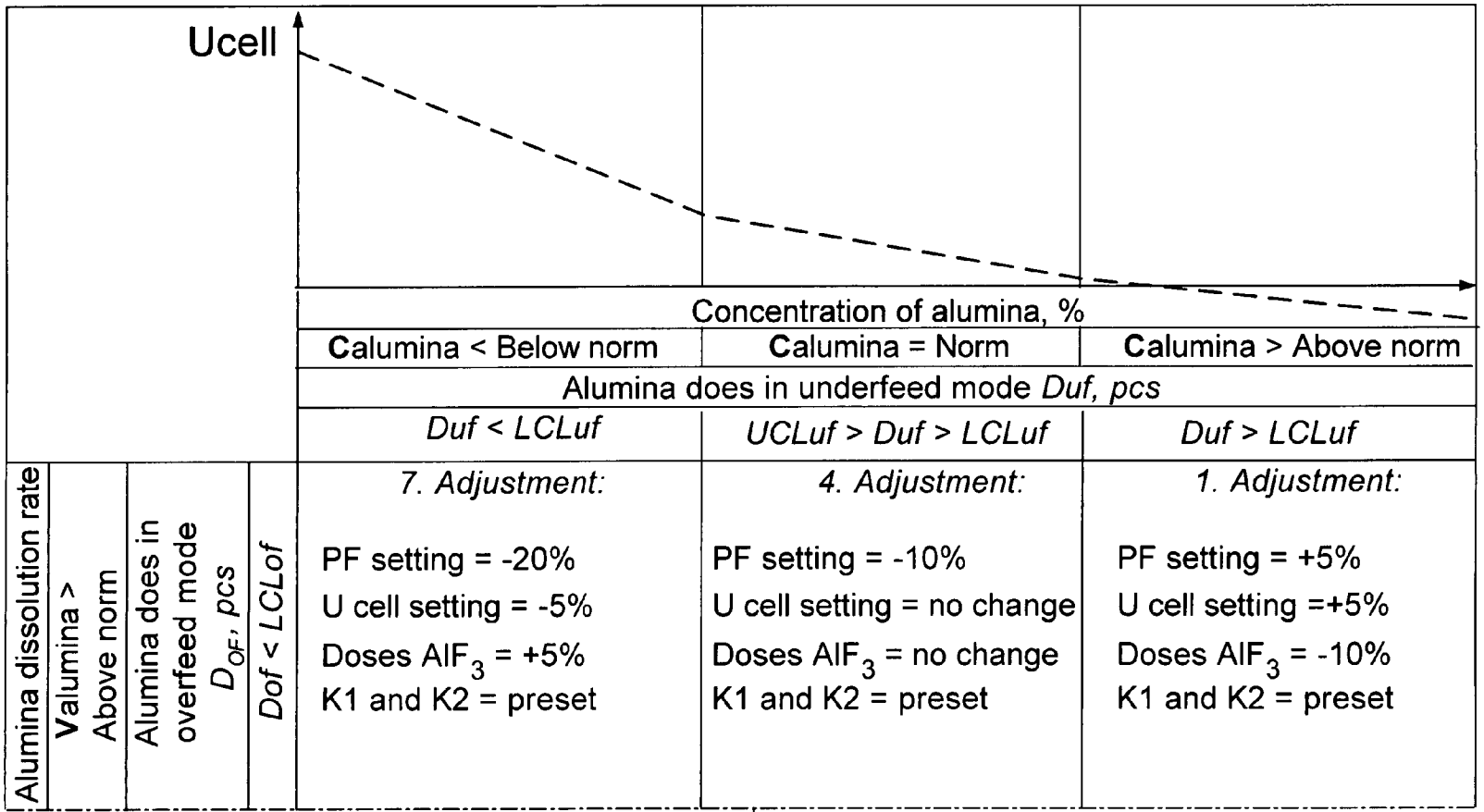
F I G. 2A Nine-dimensional matrix

↑ See FIG.2A

| Alumina dissolution rate | Alumina does in overfeed mode $D_{OF}$, pcs | | | | |
|---|---|---|---|---|---|
| | | | *UCLof > Dof > LCLof* | *Dof > UCLof* | |
| Valumina = Norm | | | *8. Adjustment:*<br>PF setting = -10%<br>U cell setting = -2.5%<br>Doses $AlF_3$ = +5%<br>K1 and K2 = preset. | *5. Adjustment:*<br>PF setting = no change<br>U cell setting = no change<br>Doses $AlF_3$ = no change<br>K1 and K2 = preset | *2. Adjustment:*<br>PF setting = +10%<br>U cell setting =+2.5%<br>Doses $AlF_3$ = -5%<br>K1 and K2 = preset |
| Valumina < Below norm | | | *9. Adjustment:*<br>PF setting = +40%<br>U cell setting = +10%<br>Doses $AlF_3$ = -10%<br>K1 = +15% to preset<br>K2 = -30% to preset | *6. Adjustment:*<br>PF setting = +10%<br>U cell setting = +5%<br>Doses $AlF_3$ = -10%<br>K1 and K2 = preset | *3. Adjustment:*<br>PF setting = +20%<br>U cell setting =+5%<br>Doses $AlF_3$ = -10%<br>K1 and K2 = preset |

F I G. 2B. Nine-dimensional matrix

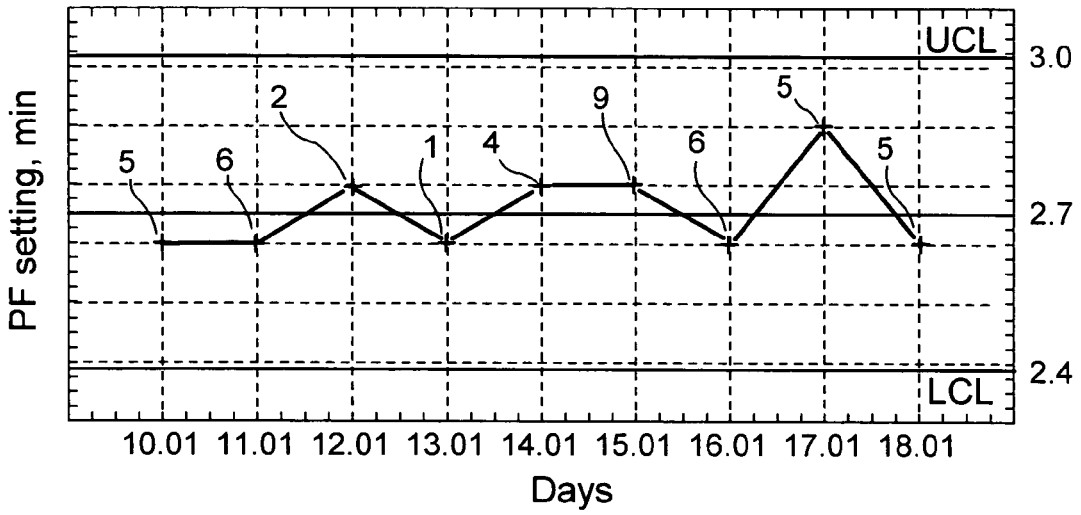
F I G. 3A. Shewhart control chart -- individual values (I-MR): PF setting (sigma = 0.088)
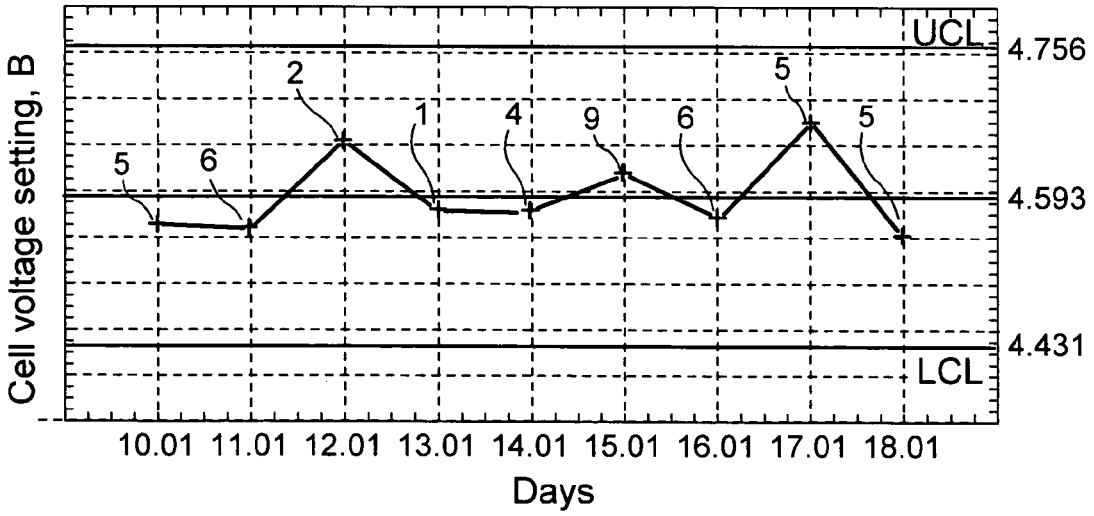
F I G. 3B. Shewhart control chart -- individual values (I-MR): cell voltage setting (sigma = 0.054)

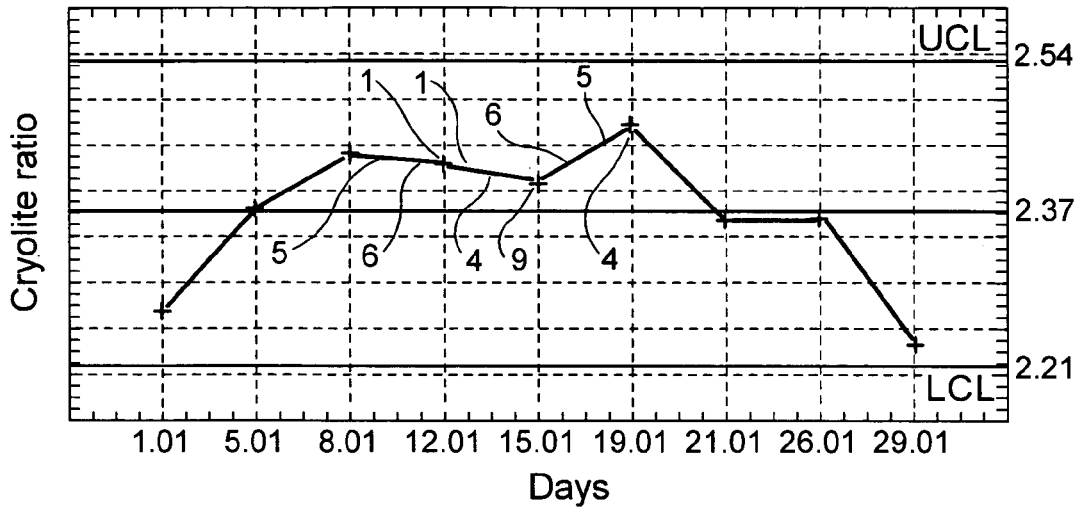
F I G. 3C. Shewhart control chart -- individual values (I-MR): cryolite (sigma = 0.055)
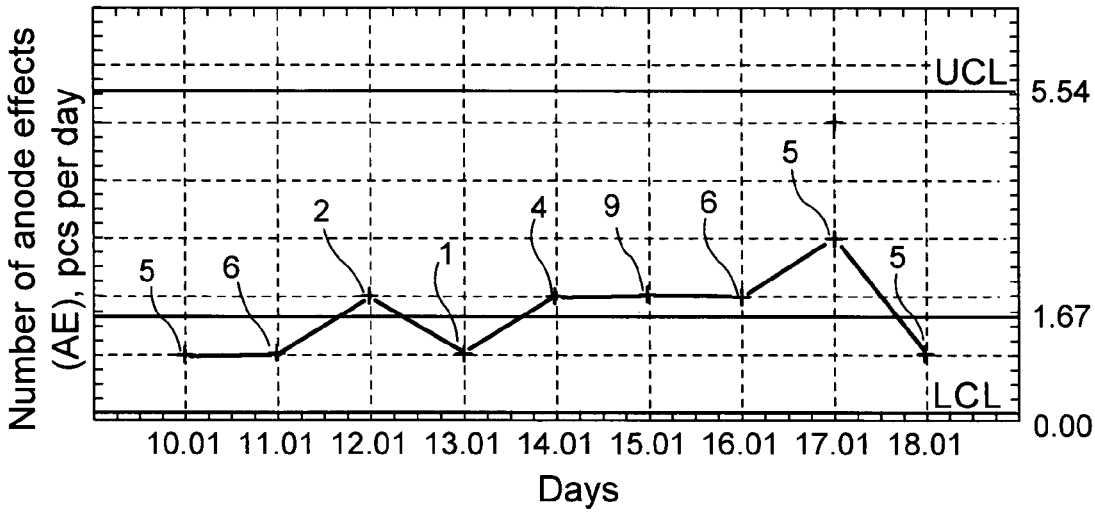
F I G. 4A. Shewhart control chart -- individual values (I-MR) of the number of anode effects (AE)(sigma = 1.3)

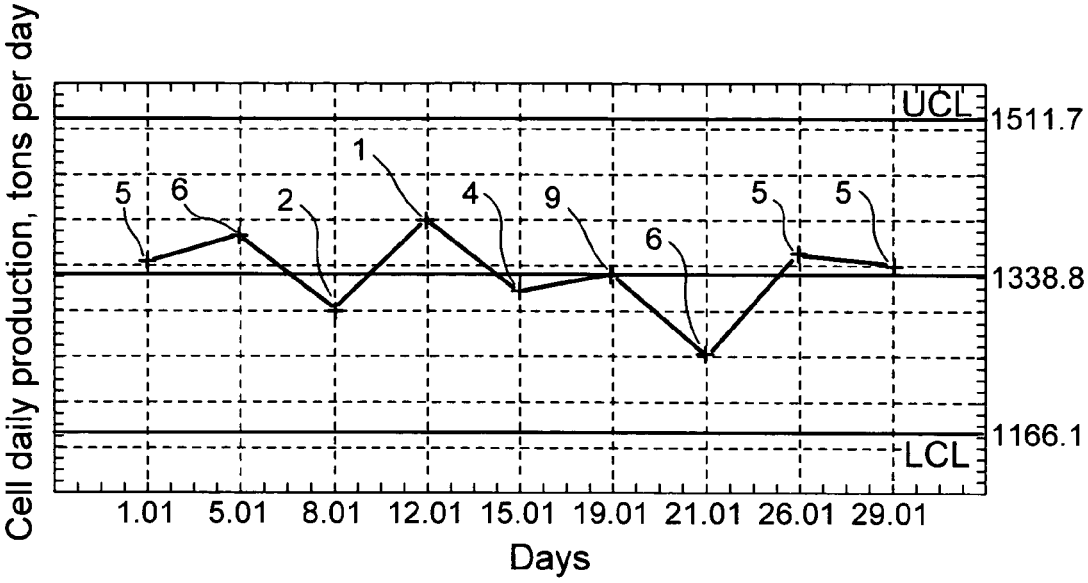
F I G. 4B. Shewhart control chart -- individual values (I-MR): cell daily production (sigma = 57.6)

METHOD OF CONTROLLING AN ALUMINUM CELL WITH VARIABLE ALUMINA DISSOLUTION RATE

FIELD OF THE INVENTION

The invention relates to non-ferrous metallurgy. More specifically, it relates to a method of controlling an aluminum cell adapted for producing aluminum by electrolytic treatment of alumina.

BACKGROUND OF THE INVENTION

In order to produce aluminum, aluminum oxide (alumina) is molten at high temperature in a bath comprising cryolite and other fluorine salts. Molten aluminum oxide decomposes in an electrolytic cell under the action of direct current passing through the bath. The pure aluminum deposits on the cathodes, while the oxygen oxidizes and consumes the anodes.

With time, the amount of alumina in the bath decreases. When the alumina concentration in the bath decreases to 0.5-1.5%, a special mode of cell operation occurs known as the anode effect, which is accompanied by low level of the cell performance.

During operation, to maintain satisfactory cell performance new doses of alumina are added to the melt at regular time intervals or alternatively continuously supplying alumina by alumina feeding mechanisms (AF mechanisms).

It is known that in order to efficiently control the electrolytic process it is necessary to stabilize the power conditions and material balance thereof. Among the objects of the method of controlling electrolysis of aluminum is achieving the best cell performance, and for this purpose, establishing optimum conditions for dissolution of alumina and stabilizing the alumina concentration under variable process parameters, quality of raw materials, etc. Among known methods of process control for aluminum cell operation are the methods which are based on the normalized voltage and the direction of anode movement characteristics A method of automatic control of an aluminum cell comprises the steps of measuring cell voltage and cell current, calculating current values of the cell resistance, establishing the baseline value of resistance or normalized voltage before addition of each dose of alumina. The minimum value of normalized voltage $U_{norm}^{min}$ is used as a process control set point. In case of discrepancy between the normalized voltage $U_{norm}$ and current value of normalized voltage $U_{norm\ rcur.}$, the anode is moved and all such movements are recorded. When the anode movements are mostly in the downward direction, the concentration value of the cell is set as decreasing. When anode movements are mostly in the upwards direction, the concentration value is set as increasing. When anode movements are rare, immediately after works and before the next handling of the cell, the concentration value is set as normal. To achieve normal conditions for alumina concentration in the bath when the concentration values are increased and decreased, the alumina loading mode is corrected by addition of alumina or by other actions (See RU, 2148108).

Among major drawbacks of these prior art methods is that they do not allow timely feedback of the cell disturbances which result from changes in the electrolytic characteristics and the overall quality of raw materials. This ultimately reduces operational efficiency.

Among known methods of controlling an aluminum cell are the normalized voltage method and the mathematical modeling method. These methods apply the techniques of controlling an aluminum cell by periodic feeding of alumina into the cell, measuring the cell voltage and line current, calculating bath resistance across the anode-cathode space, determining the average value of these parameters and determining concentration of the alumina in the bath by a mathematical model, and calculating the variation of alumina feeding rate into a cell by deviation of the calculated concentration from the set value. (See Russian Patent Documents RU 2106435 and RU 2204629).

The major disadvantage of these methods is the inherent inaccuracy of the alumina concentration due to inadequacy of responsiveness of the used model to many important operational characteristics, including changes in bath temperature, quality of alumina, etc. This results in low level of stability and high fluctuations of alumina concentration in the bath.

The known methods of controlling aluminum cells further include equipping aluminum cells with point-feeding system controlled by normalized voltage and derivatives thereof. For example, a control method is utilized which maintains the temperature conditions of a cell by alternating overfeed and underfeed modes and adjusting the anode-cathode distance and alumina concentration within preset values. The method comprises measurement of cell voltage and line current, calculation of current value of normalized voltage $U_{norm}$ and the rate of changes thereof in time $dU_{norm}/dt$, comparison of calculated values with preset values and making a decision to adjust the anode-cathode distance and shifting from overfeed to underfeed modes or vice versa on the basis of such comparison (See Russian Patent Documents SU 1724713 and RU 2113552).

These methods are capable of maintaining the alumina concentration in the bath in the technologically acceptable range between 2 and 5%. However, in application of these methods the feeding mode criteria, such as a preset time of overfeed mode and maximum voltage of underfeed mode do not provide the required accuracy for maintaining the alumina concentration. In these methods only the rough estimates of $dU_{norm}/dt$ (positive/negative) are utilized.

It appears that the most relevant prior art method to the present invention is that of controlling aluminum production cells by maintain the temperature levels through alternating the overfeed and underfeed modes and adjusting the anode-cathode distance and adjusting the alumina concentration within preset values. There are the following steps in this prior art method: measuring the cell voltage and line current, calculating the current value of normalized voltage $U_{norm}$ and the rate of its changes over time $dU_{norm}/dt$, comparing the calculated values with the preset values and making a decision concerning the adjustment of the anode-cathode distance, so as to shift the method either to overfeed or underfeed modes. This occurs on the basis of comparison of the variation rate of normalized voltage value $dU_{norm}/dt > G_{1\ over}$ time. Transition from the overfeed mode to underfeed mode occurs when the normalized voltage variation rate over time is $dU_{norm}/dt < G_2$, where $G_1$ and $G_2$ are the threshold values of normalized voltage variation rate which are established experimentally. Furthermore, the anode-cathode distance is adjusted upon transition from the overfeed mode to underfeed mode, provided: $|U_{norm} - U_o| > \Delta U$, where $U_0$ is the nominal value of normalized voltage, $\Delta U$ is predetermined by the process requirements a zone of insensitivity (See Russian Patent Document RU 2189403).

In the prior art method, the base mode is the mode which takes place at the moment of transition from the overfeed mode to the underfeed mode. The base mode time is calculated based on the cell output (daily alumina doses). In this mode the pseudo resistance of the cell is almost constant. Therefore, at this specific time, the anode beam position is corrected.

Among major drawbacks of this prior art method is that it does not take into account changes in the alumina concentration in the bath resulting from changes in the quality of raw materials, electrolytic parameters, and characteristics of the alumina feeding device, i.e. alumina dose mass. Furthermore, the rate of $dU_{norm}/dt$ responds only to the concentration of alumina dissolved within the bath. When the rate of alumina dissolution decreases during the high level massive alumina feed (i.e. the overfeed mode), the $dU_{norm}/dt$ rate is of considerable importance, as it indicates about the necessity to add alumina into the pot. This occurs even though such addition is not required. Thus, the alumina point-feeding system control often responds in the way which is opposite to the required one. Thus, in highly undesirable fashion, this prior art system carries out massive loading of alumina during the overfeed mode. In response the pot becomes overburdened with alumina, and alumina muck is formed at the bottom of the cell. As a result, the actual fluctuations of alumina concentration in the bath become impermissibly high. This causes increased frequency of the anode effects and increased frequency of turning on the motors adapted to move the anode carbon (i.e. squeezing of the pot). This increases the number and severity of process malfunctions and causes deterioration of the cell performance. The latter results in the increase of power consumption, the decrease of cell output, and the increase in labor to eliminate the process problems.

Inability to obtaining the desired technological results arises because the algorithm of the prior art method does not take into accounts variables such as the changes in the quality of raw materials, the rate of alumina dissolution, and the characteristics of electrolysis and the point-feeding system.

SUMMARY OF THE INVENTION

One of the objects of invention is to establish optimal conditions for dissolution of alumina and electrolytic cell output by enhancing the operational control of an electrolytic cell utilizing the alumina point-feeding system.

Another important object of the invention is, for the purposes of required corrective actions, to define the timing of changes in the rate of alumina dissolution in the pot, and to provide optimal conditions for alumina dissolution, by adjusting the power and material balance of the cell. It is a feature of the invention that the technical-economical indices of the process of electrolysis is improved thereby.

To achieve the objects of the invention, in the method of controlling an aluminum cell provided with an alumina point-feeding system, the alumina concentration is maintained within preset limits shifting among the base, overfeed and underfeed modes. The method comprises the steps of measuring the cell voltage and line current, calculating the current value of normalized voltage $U_{norm}$ and the rate of its variation over time $dU_{np}/dt$; comparing the calculated values with the preset values; and correcting the anode-cathode distance during the transition to and from overfeed and underfeed modes. In the method of the invention, further step is provided, namely, measuring the alumina doses delivered by the point-feeding system in the underfeed mode $D_{UF}$ and in the overfeed mode $D_{OF}$. This measuring step is carried out within the time period sufficient to evaluate alumina dissolution conditions. Further steps are determining the electrolysis imbalance by utilizing a multivariate control chart, such as the Shewhart control chart, and concurrently analyzing the criteria of special reasons of alumina doses ($D_{UF}$ИD$_{OF}$), determining corrections required for the electrolytic process based on nine-dimensional matrix. Such corrective actions include changing the base constant of the point-feeding system modes (i.e. settings, coefficients that determine overfeed periods K1 and underfeed periods K2), changing the cell voltage settings, and changing the influx of aluminum fluoride into the cell cavity.

In the method of the invention, each time interval for measuring the number of alumina doses by the point-feeding system is at least 24-hours in duration.

In the method of the invention which uses the nine-dimensional matrix, to determine the malfunction of the electrolysis the following steps are to be taken:

The first cell of the nine-dimensional matrix is characterized as follows: $D_{UF}>UCL_{UF}$ and $D_{OF}<LCL_{OF}$, where $UCL_{UF}$ is the upper control limit in the Shewhart chart in the underfeed mode; $LCL_{OF}$ is the lower control limit in the Shewhart chart in the overfeed mode. In this instance the process of electrolysis is corrected by increasing the alumina point-feeding system settings by not more than 5%, increasing the cell voltage setting by not more than 5% and decreasing the aluminum fluoride dose by not less than 10%, while the coefficients K1 and K2 remain at the earlier preset values.

During the same process in the second cell of the matrix (at which $D_{UF}>UCL_{UF}$ and $UCL_{OF}>D_{OF}>LCL_{OF}$, where $UCL_{OF}$ is the upper control limit in the Shewhart chart in the overfeed mode), the electrolysis is corrected by increasing the alumina point-feeding system settings by not more than 10%, increasing the cell voltage setting by not more than 2.5% and decreasing the aluminum fluoride dose by not less than 5%, while the coefficients K1 and K2 remain at preset values.

The third cell of the nine-dimensional matrix is characterized as follows: $D_{UF}>UCL_{UF}$ and $D_{OF}>UCL_{OF}$. In this instance the process of electrolysis is corrected by increasing the alumina point-feeding system settings by not more than 20%, increasing the voltage setting by not more than by 5% and decreasing the aluminum fluoride dose by not less than 10%, while the coefficients K1 and K2 remain at the preset values.

In the fourth cell of the nine-dimensional matrix (at which $UCL_{UF}>D_{UF}>LCL_{UF}$ and $D_{OF}<LCL_{OF}$, where $LCL_{UF}$ is the upper control limit in the Shewhart chart in the underfeed mode), the electrolysis is corrected by decreasing the alumina point-feeding system settings by not more than 10%. In this process, the voltage setting, the aluminum fluoride dose, the coefficients K1 and K2 are substantially equal to the earlier set values.

In the fifth cell of the nine-dimensional matrix (wherein $UCL_{UF}>D_{UF}>LCL_{UF}$ and $UCL_{OF}>D_{OF}>LCL_{OF}$), the electrolytic process is not being corrected. In this situation, settings of the point-feeding system, the setting of voltage, aluminum fluoride dose, as well as the coefficients K1 and K2 remain at the preset values.

In the sixth cell of the nine-dimensional matrix (wherein $UCL_{UF}>D_{UF}>LCL_{UF}$ and $D_{OF}>UCL_{OF}$), the electrolytic process is corrected by increasing the alumina point-feeding system settings by not more than 10%, increasing the voltage setting by not more than 5%, decreasing the aluminum fluoride dose by at least 10%, while the coefficients K1 and K2 are kept at the preset values.

In the seventh cell of the nine-dimensional matrix (wherein $D_{UF}<LCL_{UF}$ and $D_{OF}<LCL_{OF}$), the electrolysis is corrected by decreasing the alumina point-feeding system settings by not more than 20%, decreasing the voltage setting by not more than 5%; while the aluminum fluoride dose and the K1 and K2 coefficients remain to be substantially equal to the earlier set values.

In the eighth cell of the nine-dimensional matrix (wherein $D_{UF}<LCL_{UF}$ and $UCL_{OF}>D_{OF}>LCL_{OF}$), the electrolysis is corrected by decreasing the alumina point-feeding system settings by not more than 10%, decreasing the voltage setting by not more than 2.5%, increasing the aluminum fluoride dose by at least 5%, while the K1 and K2 coefficients remain to be substantially equal to the earlier set values.

In the ninth cell of the nine-dimensional matrix (wherein $D_{UF}<LCL_{UF}$ and $D_{OF}>UCL_{OF}$), electrolysis is corrected by increasing the alumina point-feeding system settings not more than by 40%, increasing K1 coefficient by at least 15% of the earlier set value, decreasing the K2 coefficient by at least 30% of the earlier set value, increasing the voltage setting by not more than 10% and decreasing the aluminum fluoride dose by at least 10%.

The method can be specified by the following: the range $UCL_{UF}>D_{UF}>LCL_{UF}$ is taken to be $\pm 2\sigma_{UF}$ and the range $UCL_{OF}>D_{OF}>LCL_{OF}$ is taken to be $\pm 2\sigma_{OF}$, Where $\sigma_{UF}$ is the mean square deviation of the number of alumina doses in the underfeed mode and $\sigma_{OF}$ is the mean square deviation of the number of alumina doses in the overfeed mode over the period of not less than 25 days, respectively.

BRIEF DESCRIPTION OF THE DRAWINGS

The foregoing summary as well as the following detailed description of the invention will be best understood when considered in conjunction with the accompanying drawings, wherein:

FIG. 1A shows the Shewhart control charts of individual points and moving range (I-MR) reflecting alumina doses in the underfeed mode $D_{UF}$;

FIG. 1B shows the Shewhart control charts of individual points and moving range (I-MR) reflecting alumina doses in the overfeed mode $D_{OF}$;

FIG. 2A shows a nine-dimensional matrix including a table and its relation with the diagram of cell voltage variation vs. alumina concentration;

FIG. 2B shows a continuation of the table associated with the nine-dimensional matrix of FIG. 2A;

FIG. 3A shows Shewhart control charts of individual points and moving range (I-MR): I-MR vs. alumina point-feeding system settings;

FIG. 3B shows Shewhart control charts of individual points and moving range (I-MR): I-MR vs. cell voltage settings;

FIG. 3C shows Shewhart control charts of individual points and moving range (I-MR): I-MR vs. cryolite ratio;

FIG. 4A shows the Shewhart control charts of individual points and moving range (I-MR): I-MR. vs. number of anode effects AE; and FIG. 4B shows the Shewhart control charts of individual points and moving range (I-MR): I-MR vs. cell daily production.

DETAILED DESCRIPTION OF THE INVENTION

This invention will be better understood with reference to the following definitions:

A. Alumina AF dose is a total mass of alumina charged into an electrolytic cell in a single feed of alumina discharged from all point feeders.

B. AF period is a time interval between discharging alumina AF doses into a cell in a given mode.

C. Frequency of alumina AF doses is the characteristic inverse to the AF period.

D. Nominal alumina AF dose is a calculated dose equal to the quantity of alumina point feeders (used in the cell) multiplied by a certified value of the alumina mass discharged by one point feeder (the alumina AF dose is not always equal to the nominal alumina AF dose).

E. Nominal setting is the calculated characteristic used for initial evaluation of the actual AF setting, which is evaluated by the following expression.

F. Nominal AF setting is the characteristic substantially equal to 1440 divided by the nominal number of alumina AF doses per day (minutes); where 1440 is the number of minutes in one 24 hours period.

G. Nominal alumina AF doses per day is the characteristic substantially equal to (daily alumina demand per pot) divided by (nominal alumina AF dose).

H. AF setting is the AF period in base mode, which is set in the controlling unit of the AF control system (in minutes), in actual practice the AF setting is chosen to be approximately equal to the Nominal setting.

I. AF period is a characteristic which in the overfeed mode is determined by the coefficient K1 for the overfeed mode and by the K2 coefficient for the underfeed mode. The values of the coefficients K1 and K2 are determined based on the AF setting.

Example: AF setting of 7 minutes is assumed as 100% value. Then, the coefficients K1 and K2 are calculated as percentage of AF setting. In the manufacturing conditions the preset coefficient values are K1=250% and K2=25% of 7 minutes.

As mentioned above, the technical-economic indices of aluminum production process, including high electrolytic cell output, are directly dependent on the rate of alumina dissolution and the operational responsiveness of the system for automatically adjusting the alumina concentration. The rate of alumina dissolution is the function of the bath super heat (the difference between the bath temperature and the temperature at which the bath freezes), the alumina dose and the quality of the alumina. The temperature of bath freezing (the liquidus temperature) depends on the chemical composition of the bath, including the concentration of aluminum fluorides, calcium, and alumina in the bath.

The prior art AF algorithm (see Russian Patent RU 2189403) responds to the value of $dU_{norm}/dt$ which reflects only the concentration of alumina dissolved in the bath. When the rate of alumina dissolution decreases, even in the case of massive alumina feed (i.e. overfeed mode), the $dU_{norm}/dt$ value is of considerably more importance and indicates that it is necessary to add alumina into the pot. Significantly, in the prior art this occurs even though such addition of alumina is not required.

In the method of the invention, such situations are controlled and rectified through the analysis of families of points of doses $D_{UF}$ and $D_{OF}$. In the invention, a more sophisticated cell control algorithm is derived from multivariate process monitoring and is based on the principles of statistical method control and statistical process control (SPC).

The method of the invention contains the following operational steps: maintaining alumina concentration within the preset limits by means of shifting among the base, underfeed and overfeed modes; measuring the cell voltage and line electrical current; calculating current normalized voltage $U_{norm}$ and the rate of its variation over time ($dU_{np}/dt$); comparing the calculated values with the preset values; and, based on the results of the comparison, correcting the anode-cathode distance which occurs in the transition of the method to and from alumina overfeed or underfeed modes.

Among the essential features of the invention are the following steps:

First, the number of alumina AF doses is measured in the underfeed mode $D_{UF}$ and in the overfeed mode $D_{OF}$ over the time period sufficient to estimate conditions of the alumina dissolution.

Analysis of additional information related to the families of points denoting the doses of $D_{UF}$ and $D_{OF}$ enables the invention to evaluate the rate of dissolution and concentration of alumina in the bath. According to experimental studies, changes in the doses $D_{UF}$ and $D_{OF}$ are functionally associated with concentration and rate of dissolution of alumina in the bath. In the underfeed mode the families of points denoting the number of $D_{UF}$ doses are found to specify the concentration of alumina $C_{AL}$ in the bath. In the overfeed mode, the families of points denoting the number of $D_{OF}$ doses specify the rate of alumina dissolution $V_{AL}$ in the bath. In the invention, the situations involving partial alumina dissolution in the bath are suggested to evaluate by joint analysis of families of points denoting the number of $D_{UF}$ and $D_{OF}$ doses.

Since the electrolytic cell is an inertial object (e.g. the process of alumina muck dissolution), the time interval for measuring the number of alumina AF doses has been chosen to be at least 24 hours in duration. Controlling the energy and material balance of a cell and completion of the transitional process requires the time period of at least 24 hours.

Second, in the invention, statistical methods are used to define the moment when the rate of alumina dissolution changes. Such statistical methods are based on Shewhart control charts (I-MR), which are developed for the number of alumina AF doses in the underfeed mode $D_{UF}$ and in the overfeed mode $D_{OF}$ (see FIGS. 1A and 1B).

The control chart method typically consists of the following steps: collecting original data; displaying such data on a control chart of a certain type; comparing the displayed points and their families with control boundaries, identifying the displayed data situated outside of the boundaries and/or families; analyzing families of points; determining assignable cause; and taking the corrective actions.

In the method of the invention, the charts of individual points and moving ranges (I-MR) have been chosen enabling a user to evaluate the process disorders. The upper control limit $UCL_I$ and the lower control limit $LCL_I$ are calculated based on the following formulas:

$$UCL_X=\overline{X}+E_2\cdot\overline{R},$$

$$LCL_X=\overline{X}-E_2\cdot\overline{R},$$

where $$\overline{X}=\frac{1}{k}\cdot\sum_{1}^{k}X_i$$

is the average value of the number of doses over a set period;

k is the number of individual parameter points;

$X_i$ is the individual value of the measured parameter ($D_{UF}$ or $D_{OF}$); and $$\overline{R}=\frac{\sum_{i=1}^{k-1}R_i}{k-1}$$

is the average moving range, where $R_i$ is the moving range, i.e. absolute value of the difference in measurements in successive pairs of points, $E_2$=2.66.

Third, electrolytic process disorders are identified by simultaneous analysis of criteria of special causes of $D_{UF}$ and $D_{OF}$ represented in the form of families of points on a control chart.

Fourth, the corrective actions are calculated based on the nine-dimensional matrix (see FIG. 2.).

The point-feeding system is assumed to be in a good operational condition. The operational integrity of the point-feeding system should be checked under working conditions at regular intervals.

Corrective actions of the method of the invention will be illustrated hereinbelow.

EXAMPLE 1

The following criteria of special causes are fixed in the following manner: $D_{UF}>UCL_{UF}$ and $D_{OF}<LCL_{OF}$ (the first cell of nine-dimensional matrix), where $UCL_{UF}$ is the upper control limit in the Shewhart control chart in the underfeed mode; and $LCL_{OF}$ is the lower control limit in the Shewhart control chart in the overfeed mode.

According to the above, the mass of alumina fed into the pot in the underfeed mode increases, while in the overfeed mode it decreases. The cell output is somewhat above normal rate.

Upon evaluation of all data, a condition of the electrolytic cell can be evaluated as follows: concentration of dissolved alumina in the bath increases (Cal>) and the dissolution rate increases (Val>). Even though the dissolution rate increases, in order to prevent formation of a muck it is necessary to take the following actions. First, it is necessary to slightly decrease alumina feed into the bath by increasing the AF setting (not more than by 5%). Second, it is necessary to take measures preventing formation of a muck by increasing a bath temperature by means of elevating the voltage set point (not more than by 5%), and to increase the cryolite ratio by decreasing the aluminum fluoride dose (not more than by 10%). These measures are adapted to control energy and material balance of the cell. Coefficients K1 and K2 remain substantially equal to their earlier set values.

EXAMPLE 2

The following criteria of special causes are fixed in the following manner: $D_{UF}>UCL_{UF}$ and $UCL_{OF}>D_{OF}>LCL_{OF}$ (second cell of nine-dimensional matrix), where $UCL_{OF}$ is the upper control limit in the Shewhart control chart in the overfeed mode.

This indicates that the mass of alumina fed into the pot in the underfeed mode increases, while in the overfeed mode it remains normal. The cell output is at the normal rate.

Upon evaluation of all available data, the condition of a cell can be described as follows: concentration of the dissolved alumina in the bath increases (Cal>) and the dissolution rate remains normal (Val=).

Even though the dissolution rate remains normal, there may be initial indications of the muck formation. In this situation, the following actions have to be taken. First, to decrease the alumina feed into the bath by increasing the AF setting (not more than by 10%). Second, it is recommended to provide conditions favorable for dissolution of the muck. This is to increase the bath temperature by increasing the voltage set point (not more than by 2.5%), and to increase the cryolite ratio by decreasing the aluminum fluoride dose (by at least 2.5%). Coefficients K1 and K2 remain equal to earlier set values.

EXAMPLE 3

The following criteria of special causes are fixed in the following manner: $D_{UF}>UCL_{UF}$ and $D_{OF}>UCL_{OF}$ (third cell of nine-dimensional matrix).

This indicates that the mass of alumina fed into the pot in the underfeed and overfeed modes increases. The electrolytic cell output is somewhat below the normal rate.

Upon evaluation of the available data, the condition of a cell can be described as follows: concentration of the alumina dissolved in the bath increases (Cal>) and the alumina dissolution rate decreases (Val<).

In this instance, it is recommended to decrease considerably the alumina feed into the cell by increasing AF setting (by not more than 20%). Furthermore, in order to increase the bath temperature it is recommended to increase the voltage set point (by not more than 5%) and to decrease the aluminum fluoride dose (by not more than 10%). Coefficients K1 and K2 remain equal to earlier set values.

EXAMPLE 4

The following criteria of special causes are fixed in the following manner: $UCL_{UF}>D_{UF}>LCL_{UF}$ and $D_{OF}<LCL_{OF}$ (fourth cell of nine-dimensional matrix), where $LCL_{UF}$ is the lower control limit in the Shewhart control chart in the underfeed mode.

This indicates that the mass of alumina fed into the pot in the underfeed mode is normal, while in the overfeed mode it decreases. The cell output is somewhat above the normal rate.

Upon evaluation of the available data, the condition of a cell can be estimated as follows. The concentration of the dissolved alumina in the bath is normal (Cal=) and the dissolution rate of alumina increases (Val>). This is the first indication that the electrolytic cell output increases.

In the circumstances, the following actions are recommended. To increase the alumina feed into the bath by decreasing the AF setting (by at least 10%). On the other hand, the cell voltage setting, aluminum fluoride dose, and coefficients K1 and K2 remain equal to the earlier set values.

EXAMPLE 5

The criteria of special causes are fixed in the following manner: $UCL_{UF}>D_{UF}>LCL_{UF}$ and $UCL_{OF}>D_{OF}>LCL_{OF}$ (fifth cell of nine-dimensional matrix).

In this situation the mass of alumina fed into the pot in the underfeed mode and in the overfeed mode are normal. The cell output also remains normal.

This mode is characterized by the normal concentration of alumina (Cal=) and the normal rate of its dissolution in the bath (Val=). The process conditions of the cell are also normal and do not require correction.

EXAMPLE 6

The following criteria of special causes are fixed in the following manner: $UCL_{UF}>D_{UF}>LCL_{UF}$ and $D_{OF}>UCL_{OF}$ (sixth cell of nine-dimensional matrix).

In this situation, the mass of alumina fed into the pot in the underfeed mode is normal, while in the overfeed mode it increases. The cell output is somewhat below the normal rate.

As to the condition of a cell, concentration of the dissolved alumina in the bath is normal (Cal=) and the alumina dissolution rate decreases (Val<). This is the initial indication that the electrolytic cell output is decreasing.

In the circumstances, the following actions are recommended. First, in order to decrease formation of a muck, the alumina feed into the bath should be decreased by increasing the AF setting (by not more than 10%), the. Second, in order to create conditions favorable for the dissolution of a muck, it is recommended to increase the temperature of the bath by increasing the voltage set point (by not more than 5%) and to increase the cryolite ratio by decreasing the aluminum fluoride dose (by not more than 10%). Coefficients K1 and K2 remain equal to the earlier set values.

EXAMPLE 7

The following criteria of special causes are fixed in the following form: $D_{UF}<LCL_{UF}$ and $D_{OF}<LCL_{OF}$ (seventh cell of nine-dimensional matrix)

In this situation, the mass of alumina fed into the pot in the underfeed and overfeed modes decreases. The cell output substantially increased with respect to the normal operation.

As to the cell conditions, concentration of the dissolved alumina in the bath decreases (Cal<) and the dissolution rate of alumina increases (Val>).

In this situation, the following actions are recommended. First, it is recommended to decrease the AF setting (i.e. to increase the amount of alumina fed into the pot), by not more than 20%. Second, it is recommended to reduce the bath temperature by decreasing the voltage set point (by not more than 5%). The aluminum fluoride dose and the coefficients K1 and K2 remain substantially equal to the earlier set values.

EXAMPLE 8

The following criteria of special causes are fixed in the following form: $D_{UF}<LCL_{UF}$ and $UCL_{OF}>D_{OF}>LCL_{OF}$ (eighth cell of nine-dimensional matrix).

In this situation, the mass of alumina fed into the pot in the underfeed mode decreases, while in the overfeed mode it remains normal. The cell output is at the above normal rate.

The conditions of a cell can be described as follows. Concentration of the dissolved alumina in the bath decreases (Cal<) and the dissolution rate remains normal (Val=). This is the initial indication that the output of the cell is being increased.

In this situation, the following actions are recommended. Initially, it is recommended to increase the dose by decreasing the AF setting (by not more than 10%). Then, it is recommended to decrease the voltage setting (by at least 2.5%) and to decrease the cryolite ratio by increasing the aluminum fluoride dose (by not more than 5%). Coefficients K1 and K2 remain substantially equal to the earlier set values.

EXAMPLE 9

The following criteria of special causes are fixed in the following manner: $D_{UF}<LCL_{UF}$ and $D_{OF}>UCL_{OF}$ (ninth cell of nine-dimensional matrix).

This indicates that the mass of alumina fed into the pot in the underfeed mode decreases, while in the overfeed mode it increases. In this situation, the cell output has been drastically reduced.

This means that a situation has been encountered when the prior art methods inadequately respond to the changes in alumina concentration in the bath. The prior art method operates according to the gradient of derivative $dU_{np}/dt$. It is known that value $dU_{np}/dt$ responds only to the concentration of alumina dissolved in the bath. When the rate of alumina dissolution is reduced, even upon utilization of the massive alumina feed (i.e. in the overfeed mode), the value of $dU_{np}/dt$ is of great importance. This is because this characteristic provides indication of the necessity to add alumina into the pot, even though such addition is not required. Thus, the AF control system responds in the manner exactly opposite to the required one, i.e. causing the loading a massive amount of alumina in the pot in the overfeed mode. Thus, the cell is overburdened with alumina, so as to cause substantial muck formation at the bottom of the pot.

In this situation, the conditions of a cell are as follows: concentration of the dissolved alumina in the bath decreases (Cal<), the dissolution rate decreases (Vrπ<), and the cell generates a large amount of muck.

In this situation, the following actions are recommended. First, it is recommended to substantially decrease the mass of alumina fed into the pot by means of increasing the AF setting (by at least 40%), increasing K1 (by not more than 15% of the preset values) and decreasing K2 (by not more than 30% of the preset values). Second, it is recommended to create favorable conditions for the dissolution of muck. This is accomplished by increasing the temperature and bath super heat by means of increasing the voltage setting (not more than by 10%). Furthermore, it is recommended to increase the cryolite ratio by decreasing the aluminum fluoride dose (e.g. by at least 10%).

The range $UCL_{UF}>D_{UF}>LCL_{UF}$ is selected to be $\pm 2\sigma_{UF}$ and the range $UCL_{OF}>D_{OF}>LCL_{OF}$ is selected to be $\pm 2\sigma_{OF}$, where $\sigma_{UF}$ is the mean square deviation of the number of alumina doses in the underfeed mode and $\sigma_{OF}$ is the mean square deviation of the number of alumina doses in the overfeed mode over the period of at least 25 days, respectively.

The magnitude of $2\sigma$ range is explained by the fact, that every value extending beyond the boundaries of $2\sigma$, can be treated as a warning about an impending situation when the process goes beyond the statistically controllable status. This is the reasons why sometimes the boundaries of $\pm 2\sigma$ are called as warning boundaries.

The mean square deviation is defined by the following formula:

$$\sigma = \sqrt{\frac{\sum_{1}^{k}(X_i - \overline{X})^2}{k-1}},$$

where $X_i$ is the measured characteristic (of alumina dose), $\overline{X}$ is the mean value of the subgroup, k is the number of individual parameter values in a subgroup.

For the continuous production process it is recommended to choose the number of observations in a subgroup from a range of 20-25 values. To calculate σ, there are 25 alumina dose values have been chosen.

Example: the method of the invention will be illustrated hereinbelow based on the operation of electrolytic cell control method.

The systems of controlling the anode-cathode distance and the system of controlling alumina concentration operate in the normal mode. In addition, the number of alumina doses is measured in the underfeed mode $D_{UF}$ and in the overfeed mode $D_{OF}$ over a preset time period (e.g. 24 hours). The values of alumina doses are entered into the Shewhart control charts of individual values and moving ranges (I-MR). Then, a proper type of point families are classified through the use of the criteria. According to the type of point family, it is defined in which part of the nine-dimensional matrix the electrolytic cell is working. Each cell of the matrix is associated with an exact command, so as to regulate either AF setting, or cell voltage setting, or aluminum fluoride addition. The purpose of the control method is to move all electrolytic cells into a central matrix cell No.5 or in to the areas in the vicinity thereof.

The method is carried out in the following sequence:

1. The systems of controlling the anode-cathode distance and the alumina concentration operate in a normal mode.
2. The number of alumina doses is measured in the underfeed mode $D_{UF}$ and in the overfeed mode $D_{OF}$ over a preset time period (e.g. during a 24 hour period).
3. Individual values of alumina doses $D_{UF}$ and $D_{OF}$ are entered into the Shewhart control charts and an existing malfunction of the electrolytic cell is determined.
4. The values of the alumina doses $D_{UF}$ and $D_{OF}$ are analyzed based on the conditions presented hereinbelow.

4a. In certain electrolytic disorders in compliance with the first cell of nine-dimensional matrix, where $D_{UF}>UCL_{UF}$ and $D_{OF}<LCL_{OF}$, where $UCL_{UF}$ is the upper control limit in the Shewhart control chart in the underfeed mode; $LCL_{OF}$ is the lower control limit in the Shewhart control chart in the overfeed mode; the electrolytic process is corrected by increasing the alumina feeding settings by not more than 5% and increasing the voltage setting by at least 10%, wherein the coefficients K1 and K2 remain substantially equal to earlier preset values.

4b. At a certain electrolytic cell disorders in compliance with the second sell of nine-dimensional matrix, wherein $D_{UF}>UCL_{UF}$ И $UCL_{OF}>D_{OF}>LCL_{OF}$, wherein $UCL_{OF}$— upper control limit in the Shewhart control chart in the overfeed mode, the electrolytic process is corrected by increasing the AF setting by not more than 10%, increasing the voltage setting by not more than 2.5% and decreasing the aluminum fluoride dose by no less than 5%, wherein the coefficients K1 and K2 remain substantially equal to earlier preset values.

4c. In certain electrolytic disorders in compliance with the third cell of nine-dimensional matrix, wherein $D_{UF}>UCL_{UF}$ and $D_{OF}>UCL_{OF}$, the electrolytic process is corrected by changing the AF settings by not more than 20%, by increasing the voltage setting by not more than 5% and by decreasing the aluminum fluoride dose by at least 10%, wherein the coefficients K1 and K2 remain substantially equal to earlier preset values.

4d. In certain electrolytic disorders in compliance with the fourth cell of nine-dimensional matrix, wherein $UCL_{UF}>D_{UF}>LCL_{HII}$ and $D_{OF}<LCL_{OF}$, where $LCL_{HII}$ is the lower control limit in the Shewhart control chart in the underfeed mode, the electrolytic process is corrected by decreasing the AF setting not more than by 10% and retaining the voltage setting, aluminum fluoride dose and the coefficients K1 and K2 remain to be substantially equal to earlier preset values.

4e. In certain electrolytic disorders in compliance with the fifth matrix cell, wherein $UCL_{UF}>D_{HII}>LCL_{UF}$ and $UCL_{OF}>D_{OF}>LCL_{OF}$, wherein the AF and voltage settings, the aluminum fluoride dose, and the coefficients K1 and K2 are not corrected.

4f. In certain electrolytic disorders in compliance with the sixth cell of nine-dimensional matrix, wherein $UCL_{HII}>D_{HII}>LCL_{HII}$ И $D_{OF}>UCL_{OF}$, the electrolytic process is corrected by changing the AF settings by not more than 10%, increasing the voltage setting by not more than by 5%, decreasing the aluminum fluoride dose by at least 10% wherein the coefficients K1 and K2 remain substantially equal to the earlier set values.

4g. In certain electrolytic disorders in compliance with the seventh matrix cell, wherein $D_{UF}<LCL_{UF}$ and $D_{OF}<LCL_{OF}$, the electrolytic process is corrected by decreasing the AF setting not more than by 20%, by decreasing the voltage setting not more than by 5%, the aluminum fluoride dose, wherein the coefficients K1 and K2 remain substantially equal to earlier set values.

4j. In certain electrolytic disorders in compliance with the eighth cell of nine-dimensional matrix, wherein $D_{UF}<LCL_{UF}$ and $UCL_{OF}>D_{OF}>LCL_{OF}$, the electrolytic process is corrected by decreasing the AF setting not more than by 10%, by decreasing the voltage setting not more than by 2.5% and by increasing the aluminum fluoride dose by at least 5%, wherein the coefficients K1 and K2 remain substantially equal to earlier set values.

4k. In certain electrolytic disorders in compliance with the ninth matrix cell, wherein $D_{HII}<LCL_{HII}$ И $D_{OF}>UCL_{OF}$, the electrolytic process is corrected by changing the AF settings by not more than 40%, increasing the voltage setting not more than by 10%, decreasing the fluoride aluminum dose not less than by 10%, wherein the coefficient K1 is increased by at least 15% of the earlier set value and the coefficient K2 is decreased by at least 30% of the earlier set value.

5. An appropriate area and/or a respective cell of the nine-dimensional matrix cell is verified and corrective (controlling) actions for the electrolytic cell are determined.

6. Control actions are performed to correct the AF mode, energy and material balance of the electrolytic cell.

EXAMPLE

In the operation of an electrolytic cell performance of the alumina feeding system over a period of 10 days has been reviewed. When the prior art method of controlling the aluminum electrolytic cell was utilized, numerous technological problems in the operation of the electrolytic cell were encountered. This was evidenced by the following process characteristics: increase of the number of anode effects (up to 2 and 3 per day), which occurred due to the increase of the muck deposits in the pot. The metal tapped from the electrolytic cell (cell daily production) was decreased. During this time period the cell numbers of the nine-dimensional matrix cells (see FIG. 2) were as follows: 1, 1, 7, 9, 1, and 1. This identifies the cell mode operations as being abnormal in view of the high alumina content and muck deposits due to reduced rate of alumina dissolution. One explanation of this disorder is that the algorithm of the prior art method can not perform the task of controlling the alumina concentration, when the rate of alumina dissolution in the bath changes, and the adequate corrective measures have not been taken. The AF setting response lagged the changes in the cell. In this respect, as illustrated in FIGS. 1A and 1B, according to the nine-dimensional matrix the 11.01 setting had to be increased. However, the algorithm of the prior art method increased only 12.01 and 13.01 settings. On the other hand, the 16.01 setting was even decreased, and the 15.01 setting was increased insufficiently. Furthermore, 11.01, 13.01and 16.01 voltage settings were not increased and 15.01 voltage setting was increased insufficiently. In the setting from 11.01 to 17.01 the aluminum fluoride doses (associated with the increase the cryolite ratio) were not increased (see FIGS. 3A, 3B and 3C). Because of these actions, the next day after the above discussed improper corrections, in the settings 11.01, 13.01 and 15.01, the metal recovery decreased (see, FIGS. 4A and 4B). It is important to understand that timely corrections of the process in the aluminum cell in accordance with the method of the invention is capable of preventing the decrease in metal recovery and reduction of AE frequency. As a consequence, the method of the invention improves technical/economic characteristics of the aluminum cell, such as current and power efficiency.

It has been demonstrated hereinabove that the method of the invention is capable of creating optimum conditions for alumina dissolution and improve quality control of an electrolytic cell equipped with the alumina feeding systems. The invention enables the user to define a moment when the rate of alumina dissolution in the pot changes, so as to take timely corrective actions and to create optimum conditions for alumina dissolution by controlling the energy and material balance in the cell. All of the above improve performance of the electrolytic process. The method of the invention utilizes an improved aluminum cell control algorithm which is based on the principles of statistical control methods and statistical process control (SPC) and enables the user to take timely corrective actions on the basis of nine-dimensional matrix.

Thus, implementation of the method of controlling an aluminum reduction cell improves technical/economic characteristics of electrolysis by rapid and precise detection of the decrease in the alumina dissolution rate and facilitates timely corrections of the energy and material balances of the cell.

What is claimed is:

1. A method for controlling operation of an aluminum reduction cell having automatic alumina feed, the method comprising the following steps:

maintaining alumina concentration by alternating base, underfeed and overfeed modes, measuring cell voltage and potline amperage, calculating current normalized voltage value and a rate of changing thereof over time comparing the calculated values of said normalized voltage with preset values thereof and correcting anode-cathode distance when passing from said base mode to said overfeed or underfeed modes, measuring a number of alumina feed doses in said underfeed mode and overfeed mode over a time period sufficient to evaluate conditions of alumina dissolutions and taking corrective actions including changing base constant of the point-feeding modes by changing coefficients K1 defining said overfeed mode and coefficient K2 defining said underfeed mode of alumina feeding system, changing cell voltage settings and changing aluminum fluoride additions in to the cell.

2. The method according to claim 1, wherein electrolytic disorders are determined by entering a number of alumina doses into a control chart, while simultaneously conducting analysis according to criteria of special causes of the alumina doses in said underfeed and overfeed modes, determining required correction of an electrolytic process on the basis of, a mathematical model, and resolving said mathematical model.

3. The method according to claim 2, wherein said mathematical model is multi-dimensional matrix and time intervals for said measuring alumina doses are at least twenty-four hours duration.

4. The method as claimed in claim 3, wherein in at least some said electrolytic disorders according to a second matrix cell of said dimensional matrix the electrolytic process is corrected by increasing the automatic alumina feed setting by not more than 10%, increasing the voltage setting by not more than 2.5% and decreasing the aluminum fluoride dose by at least 5%.

5. The method according to claim 4, wherein the coefficients K1 and K2 remain substantially equal to earlier preset values.

6. The method according to claim 3, wherein in at least some said electrolytic disorders according to a third matrix cell of said multi-dimensional matrix the electrolytic process is corrected by changing the automatic alumina feed settings by not more than 20%, by increasing the voltage setting by not more than 5% and by decreasing the aluminum fluoride dose by at least 10%.

7. The method according to claim 6, wherein the coefficients K1 and K2 remain substantially equal to the earlier preset values.

8. The method according to claim 3, wherein in at least some said electrolytic disorders according to a fourth matrix cell of said multi-dimensional matrix, the electrolytic process is corrected by decreasing the AF setting by not more than by 10%, whereby the voltage setting and the aluminum fluoride dose remain to be substantially equal to the earlier preset values.

9. The method according to claim 8, wherein the coefficients the K1 and K2 remain substantially equal to the earlier preset values.

10. The method according to claim 3, wherein in at least some electrolytic disorders according to a fifth matrix cell of said multi-dimensional matrix the automatic alumina feed and voltage settings, the aluminum fluoride dose and the coefficients K1 and K2 are not corrected.

11. The method according to claim 3, wherein in at least some electrolytic disorders according to a sixth matrix cell of said multi-dimensional matrix the electrolytic process is corrected by changing the automatic alumina feed settings by not more than 10%, increasing the voltage setting by not more than by 5% and decreasing the aluminum fluoride dose by at least 10%.

12. The method according to claim 11, wherein the coefficients K1 and K2 remain substantially equal to the earlier preset values.

13. The method according to claim 3, wherein in at least some electrolytic disorders according to a seventh matrix cell of said multi-dimensional matrix the electrolytic process is corrected by decreasing the automatic alumina feed setting by not more than 20%, by decreasing the voltage setting by not more than 5%, whereby the aluminum fluoride dose remain substantially equal to earlier preset values, and the coefficients K1 and K2 remain substantially equal to earlier preset values.

14. The method according to claim 3, wherein in at least some said electrolytic disorders according to a ninth matrix cell of said multi-dimensional matrix, the electrolytic process is corrected by changing the automatic alumina feed settings by not more than 10%, decreasing the voltage setting by not more than 2.5%, and increasing the aluminum fluoride dose by at least 5% and the coefficients K1 and K2 remain substantially equal to the earlier set values.

15. The method according to claim 3, wherein in at least some of said electrolytic disorders according to an eighth matrix cell of said multi-dimensional matrix the electrolytic process is corrected by changing the automatic alumina feed settings by not more than 40%, increasing the voltage setting not more than by 10% and decreasing the fluoride aluminum dose by at least 10%.

16. The method according to claim 15, wherein the coefficient K1 is increase by at least 15% of the earlier set value and the coefficient K2 is decrease by at least 30% of the earlier preset value.

17. The method according to claim 3, wherein in at least some said electrolytic disorders according to a first matrix cell of said multi-dimensional matrix the electrolytic process is corrected by increasing alumina feeding settings by not more than 5% and increasing the voltage setting by not more than 5% and decreasing an aluminum fluoride dose by at least 10%, wherein the coefficients K1 and K2 remain to be substantially equal to earlier preset values.

18. A method for controlling operation of an aluminum reduction cell having automatic raw material feed, the method comprising the following steps:

maintaining raw material concentration by alternating base, underfeed and overfeed modes, measuring cell voltage and potline amperage, calculating current normalized voltage value and a rate of changing thereof over time, comparing the calculated values of said normalized voltage with preset values thereof and correcting anode-cathode distance when passing from said base mode to said overfeed or underfeed modes, and measuring quantity of raw material feed doses in said underfeed mode and overfeed mode over a time period so as to evaluate conditions of the raw material dissolution, wherein time of changing properties of the raw material and time when conditions of dissolution of the raw material deteriorate are determined by review of quantity of the raw material deposits during the underfeed and overfeed modes.

19. The method according to claim 18, wherein the raw material is alumina, and change from one of said underfeed and overfeed mode is based on comparison of a continuously calculated normalized resistance slope with the predetermined target thereof.

20. The method according to claim 19, wherein the quantity of alumina doses is determined by deviation of the process characteristics from the predetermined targets reflecting changes in properties of alumina and dissolution conditions.

* * * * *